US008381337B2

(12) United States Patent
Zerhusen et al.

(10) Patent No.: US 8,381,337 B2
(45) Date of Patent: Feb. 26, 2013

(54) EGRESS ASSIST FOOTBOARD

(75) Inventors: Robert M. Zerhusen, Cincinnati, OH (US); Jack Barney Sing, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 52 days.

(21) Appl. No.: 12/915,425

(22) Filed: Oct. 29, 2010

(65) Prior Publication Data

US 2012/0102655 A1 May 3, 2012

(51) Int. Cl.
*A47C 21/08* (2006.01)

(52) U.S. Cl. ..... 5/662; 5/424; 5/428

(58) Field of Classification Search ..... 5/53.1, 5/53.2, 53.3, 662, 424, 428
See application file for complete search history.

(56) References Cited

U.S. PATENT DOCUMENTS

| | | | | |
|---|---|---|---|---|
| 3,077,613 | A * | 2/1963 | Mayer | 482/139 |
| 5,279,010 | A | 1/1994 | Ferrand et al. | |
| 5,479,666 | A | 1/1996 | Foster et al. | |
| 5,680,661 | A | 10/1997 | Foster et al. | |
| 6,182,310 | B1 | 2/2001 | Weismiller et al. | |
| 6,202,231 | B1 | 3/2001 | Heimbrock et al. | |
| 6,427,264 | B1 | 8/2002 | Metz et al. | |
| 6,694,548 | B2 | 2/2004 | Foster et al. | |
| 6,704,954 | B2 | 3/2004 | Metz et al. | |
| 2009/0007334 | A1 | 1/2009 | Stryker et al. | |

* cited by examiner

*Primary Examiner* — Fredrick Conley
(74) *Attorney, Agent, or Firm* — Jason Penninger

(57) ABSTRACT

An endboard for a person-support apparatus comprises an endboard assembly including a first endboard body rotatably coupled to a frame and a second endboard body rotatably coupled to the first endboard body by a locking mechanism. The second endboard body is configured to be movable between a storage position and a deployed position with respect to the first endboard body. The locking mechanism is configured to selectively maintain the second endboard body in at least one of the storage position and the deployed position with respect to the first endboard body. The second endboard body is configured to assist a person during at least one of ingress and egress to/from the frame when the second endboard body is in the deployed position.

21 Claims, 11 Drawing Sheets

EGRESS ASSIST FOOTBOARD

BACKGROUND OF THE DISCLOSURE

This disclosure relates generally to endboard assemblies attached to person-support apparatuses. More particularly, but not exclusively, one illustrative embodiment relates to an endboard assembly configured to assist a person attempting to ingress/egress to/from a person-support apparatus.

People occasionally need assistance while attempting to ingress/egress to/from a person-support apparatus. Ingress/egress assist devices, such as, grab bars and/or handles can be used to assist a person. While various such person-support apparatuses have been developed, there is still room for improvement. Thus a need persists for further contributions in this area of technology.

SUMMARY OF THE DISCLOSURE

The present disclosure includes one or more of the features recited in the appended claims and/or the following features which, alone or in any combination, may comprise patentable subject matter.

One illustrative embodiment of the present disclosure can include an endboard with a first endboard assembly and a second endboard assembly each having a first endboard body and a second endboard body and being configured to assist a person attempting to ingress/egress to/from the person-support apparatus when the second endboard body is in a deployed position and the first endboard body is in a second rotational orientation.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

Referring now to the illustrative examples in the drawings, wherein like numerals represent the same or similar elements throughout.

DETAILED DESCRIPTION OF THE DRAWINGS

Figure 1:
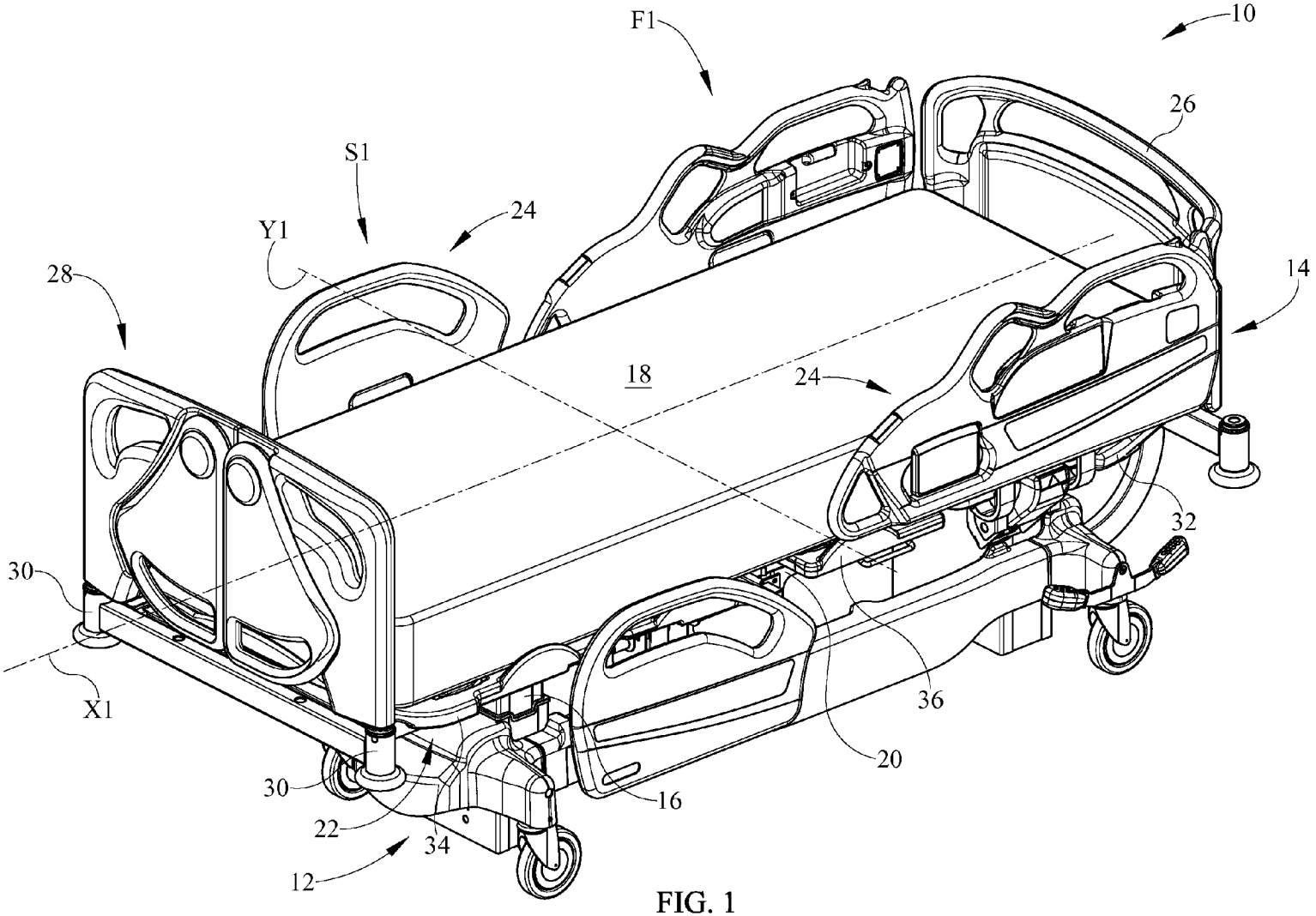
FIG. 1 is a perspective side view of a person-support apparatus with a footboard coupled thereto according to one illustrative embodiment of the disclosure.
Figure 2:
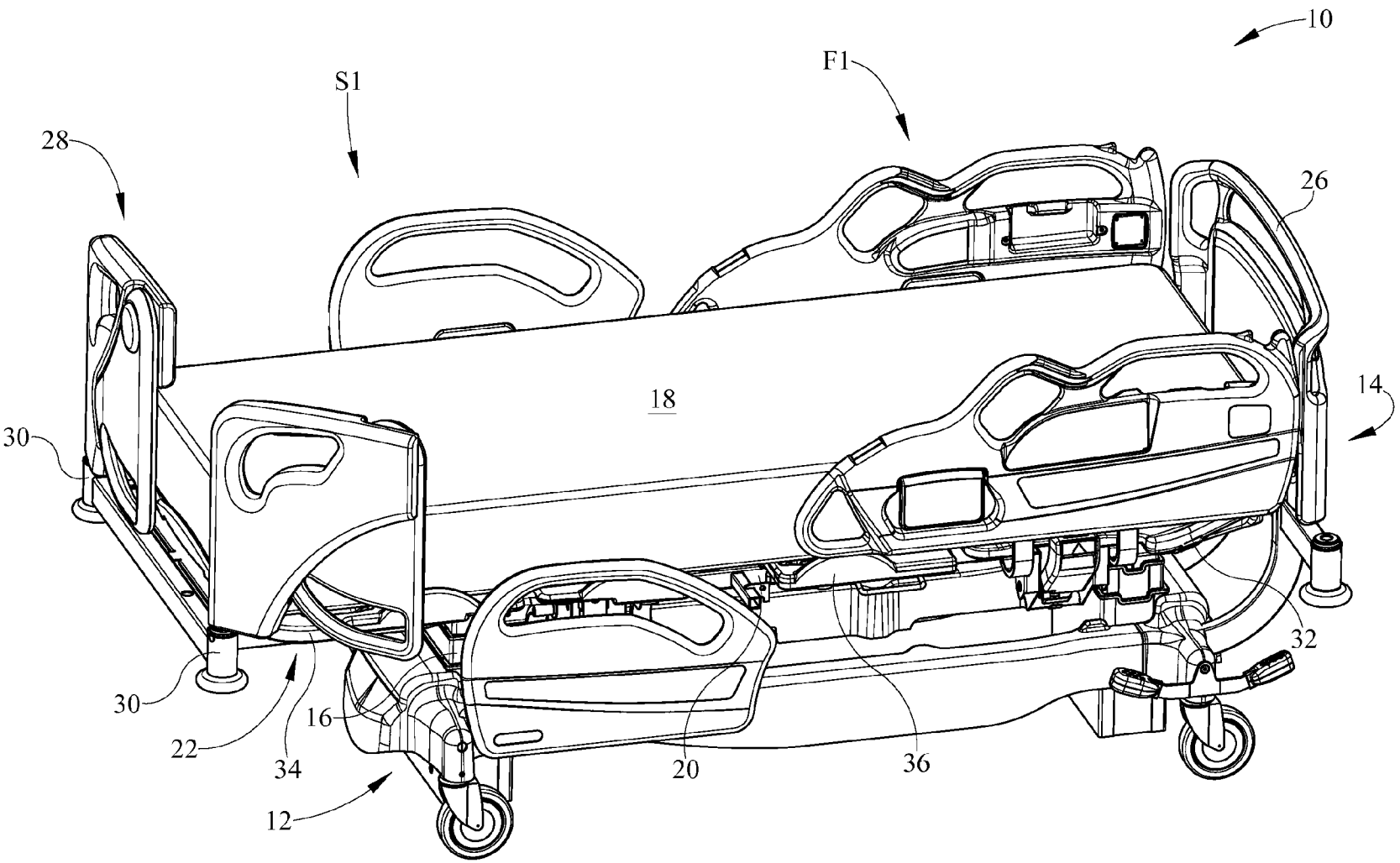
FIG. 2 is a perspective side view of the person-support apparatus of FIG. 1 in the horizontal position with the first footboard body moving from the first rotational orientation toward the second rotational orientation, and the second footboard body in the storage position.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

One illustrative embodiment of the present disclosure can include an endboard with a first endboard assembly and a second endboard assembly each having a first endboard body configured to assist a person attempting to ingress/egress to/from the person-support apparatus when the second endboard body is in a deployed position and the first endboard body is in a second rotational orientation.

A person-support apparatus 10 according to one illustrative embodiment of the current disclosure is shown in FIGS. 1-13. The person-support apparatus 10 can be a hospital bed with a first section F1 or a head support section F1, where the head of a person (not shown) can be positioned and a second section S1 or a foot support section S1, where the feet of the person (not shown) can be positioned. The person-support apparatus 10 can define a first longitudinal axis X1 passing through the first section F1 and the second section S1 and a transverse axis Y1 substantially perpendicular to the first longitudinal axis. The person-support apparatus 10 can include a lower frame 12 and an upper frame 14 supported on supports 16 above the lower frame 12. It should be appreciated that the person-support apparatus 10 can also be a hospital stretcher, an operating table, or other apparatus configured to support a person thereon. It should also be appreciated that, in one illustrative embodiment, the person-support apparatus 10 can support a person-support surface 18 or mattress 18 on the upper frame 14. The supports 16 can be lift mechanisms configured to move the upper frame 14 with respect to the lower frame 12.

The upper frame 14 can include an upper frame base 20 and a deck 22, and can have siderails 24, a headboard 26, and a footboard 28 coupled thereto as shown in FIGS. 1-6. The upper frame base 20 can include footboard receptacles 30 configured to receive a portion of the footboard 28 to couple the footboard 28 thereto. It should be appreciated that the upper frame base 20 can include headboard receptacles (not shown) configured to receive a portion of the headboard 26 and couple the headboard 26 thereto. It should also be appreciated that the footboard receptacles 30 and/or the headboard receptacles can be included on the deck 22. In one illustrative embodiment, the footboard receptacles 30 can have a square receptacle slot (not shown).

The deck 22 can be supported on the upper frame base 20 and can include multiple sections, such as, a head section 32, a foot section 34, and a seat section 36 as shown in FIGS. 1-6. The sections can be configured to pivot and/or translate with respect to the upper frame base 20 and one another. In one illustrative embodiment, the deck 22 is configured to cooperate with the upper frame base 20 to move the person-support apparatus 10 between a substantially horizontal configuration and a chair configuration as shown in FIGS. 1-6.

Figure 3:
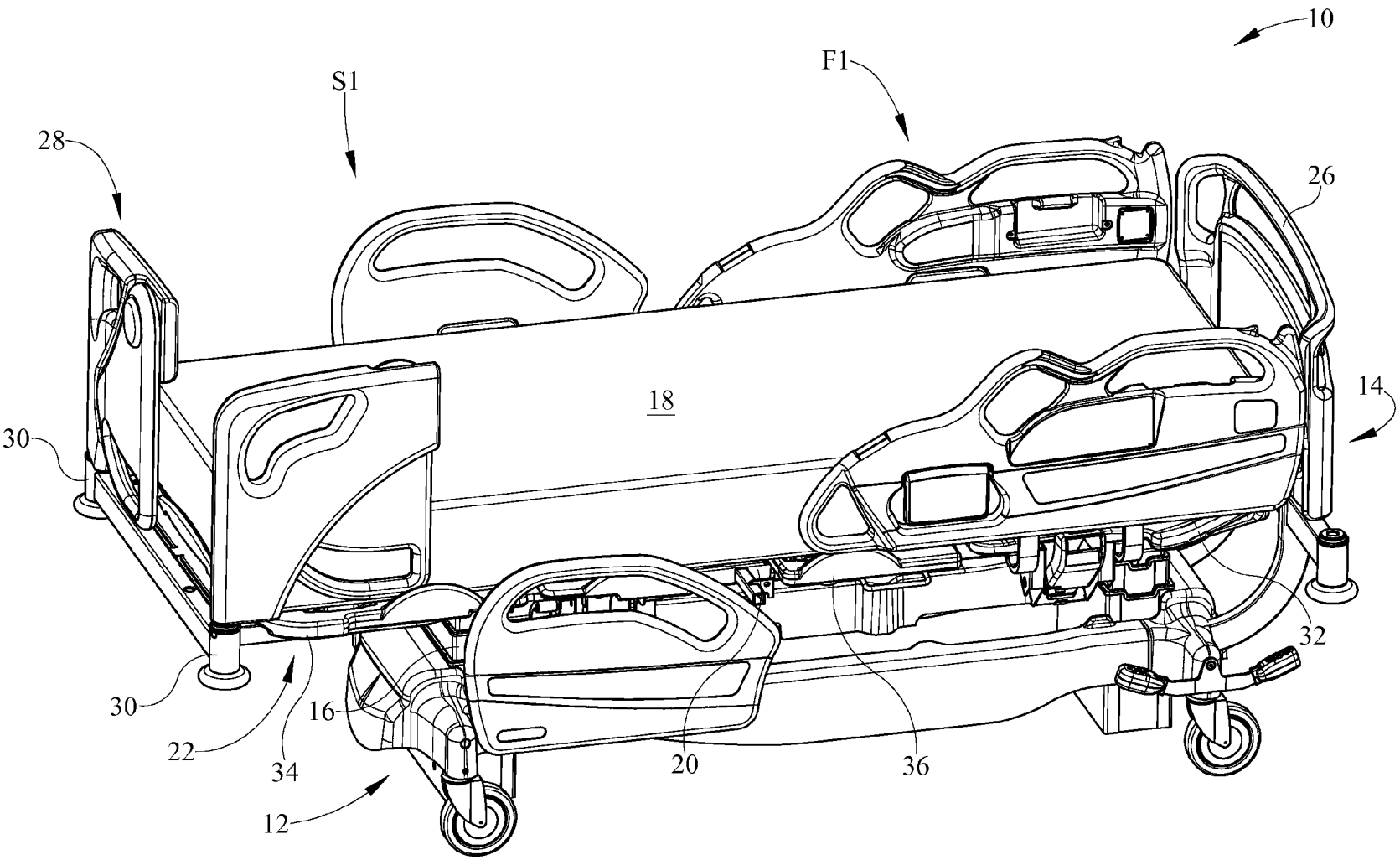
FIG. 3 is a perspective side view of the person-support apparatus of FIG. 1 in the horizontal position with the first footboard body in the second rotational orientation and the second footboard body in the storage position.
Figure 4:
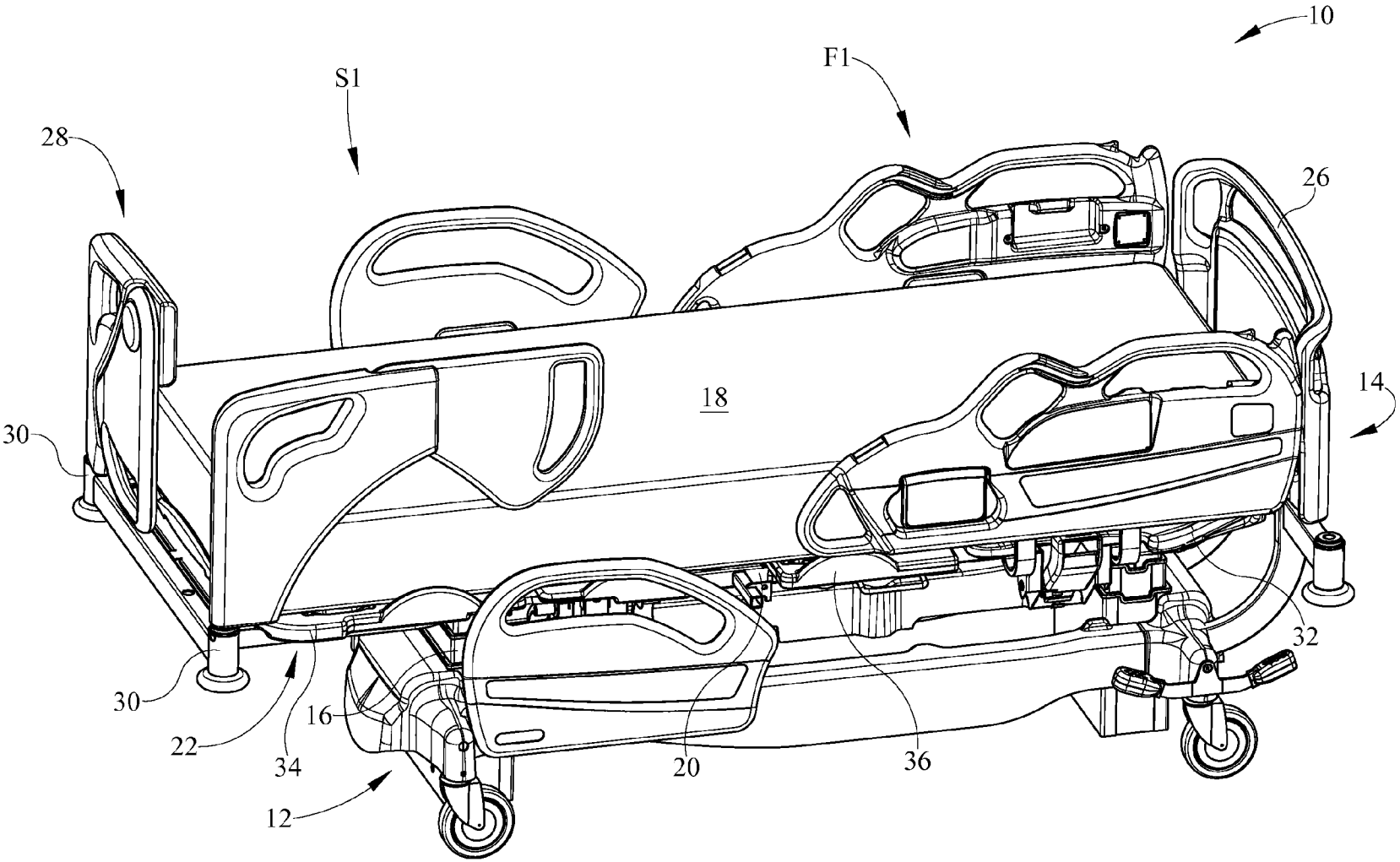
FIG. 4 is a perspective side view of the person-support apparatus of FIG. 1 in the horizontal position with the first footboard body in the second rotational orientation and the second footboard body in the egress position.
Figure 5:
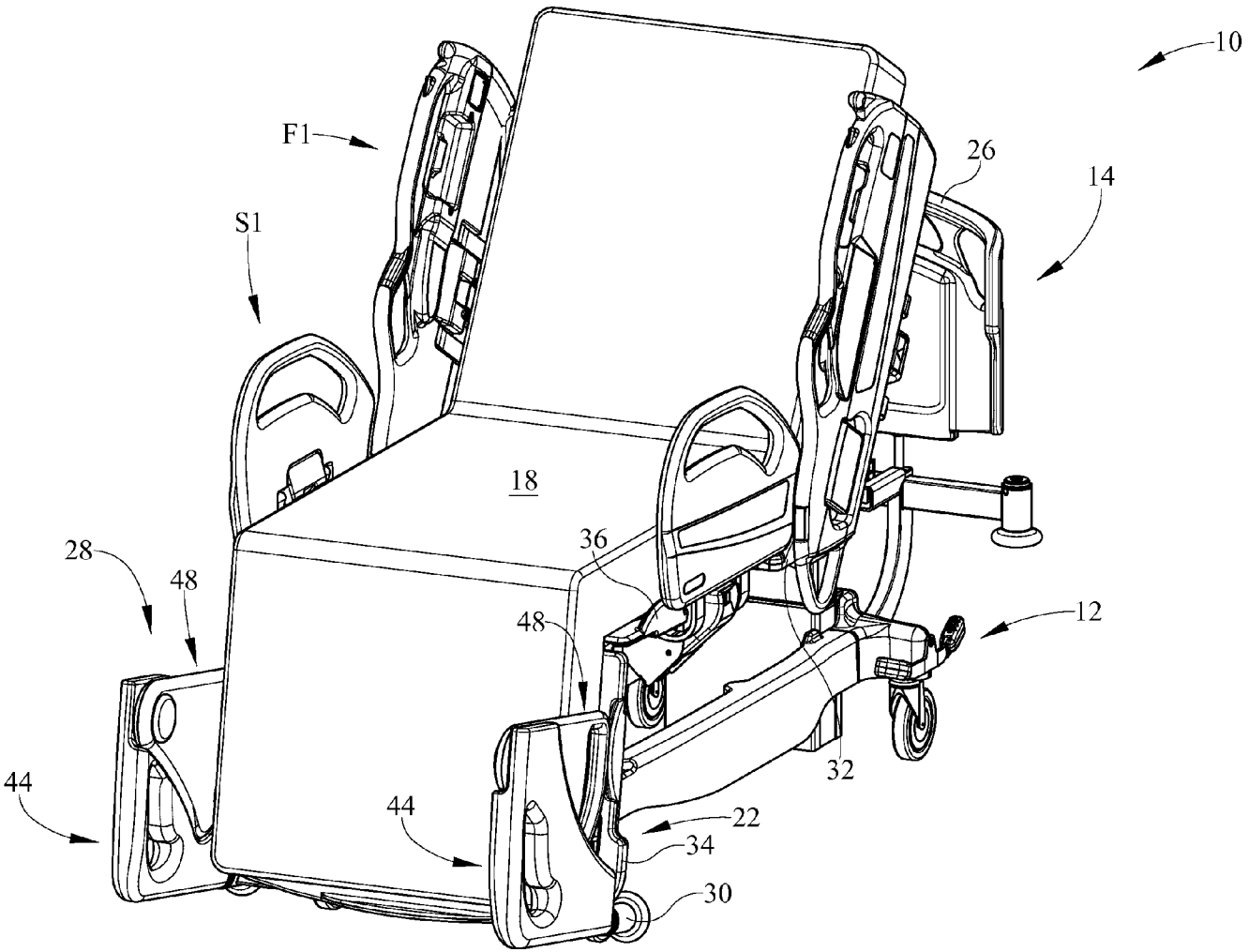
FIG. 5 is a perspective side view of the person-support apparatus of FIG. 1 in the chair position with the first footboard body in the second rotational orientation and the second footboard body in the storage position.
Figure 6:
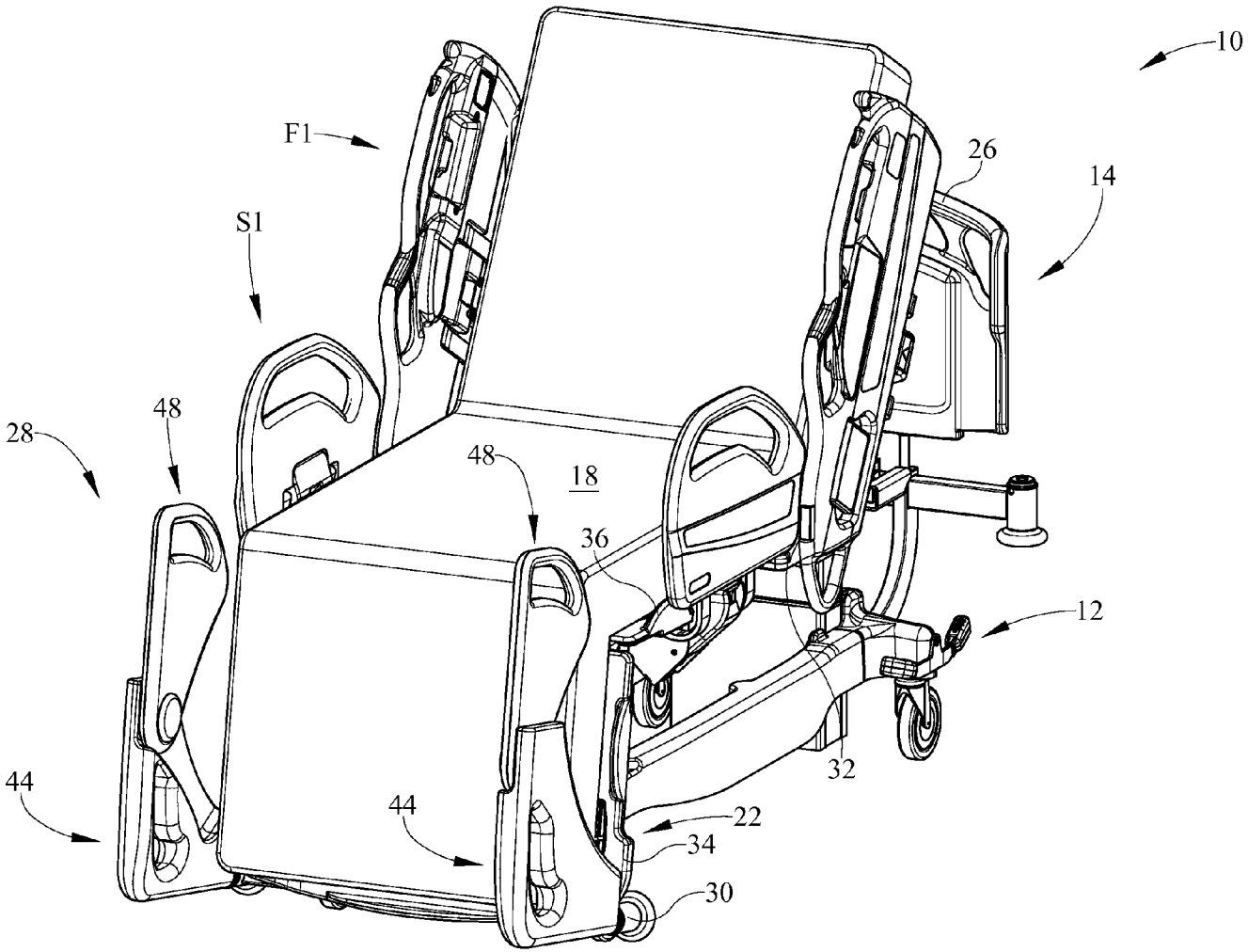
FIG. 6 is a perspective side view of the person-support apparatus of FIG. 1 in the chair position with the first footboard body in the second rotational orientation and the second footboard body in the egress position.

The footboard 28 can be configured to be used as an ingress/egress assist in multiple configurations of the person-support apparatus 10. In one illustrative embodiment, the footboard 28 can be used when the person is trying to ingress/egress to/from the sides of the person-support apparatus 10 when the person-support apparatus 10 is in the substantially horizontal configuration as shown in FIGS. 1-4. It should be appreciated that the headboard 26 can be constructed like the footboard 28 and can be used when the person is trying to ingress/egress to/from the sides of the person-support apparatus 10. In another illustrative embodiment, the footboard assembly 28 can move with the foot section 34 and can be used when the person is trying to ingress/egress to/from the person-support apparatus 10 when the person-support apparatus 10 is in the chair configuration as shown in FIGS. 5-6.

Figure 8:
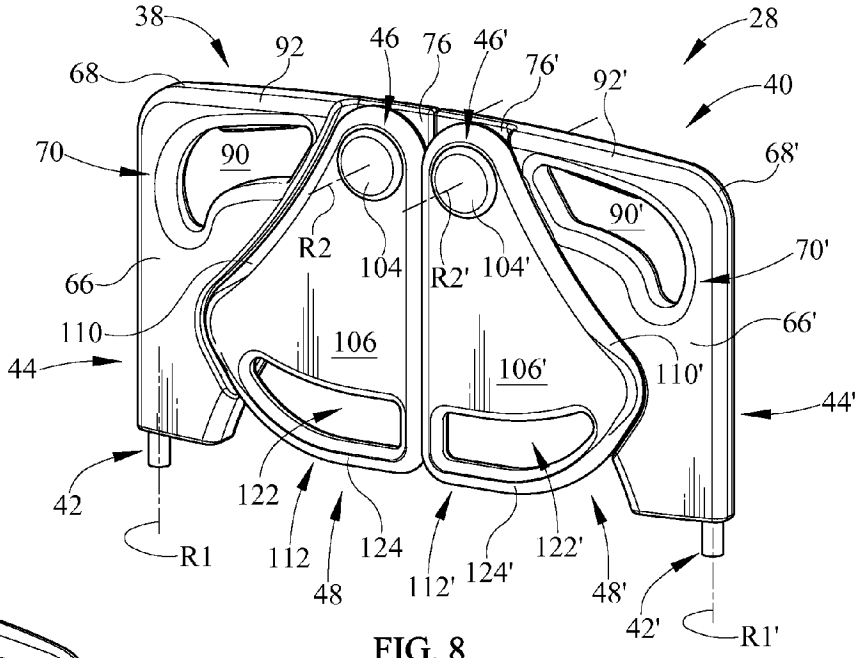
FIG. 8 is the perspective side view of the footboard of FIG. 1 showing the second footboard body coupled to the first footboard body via a second movement mechanism.
Figures 9, 10:
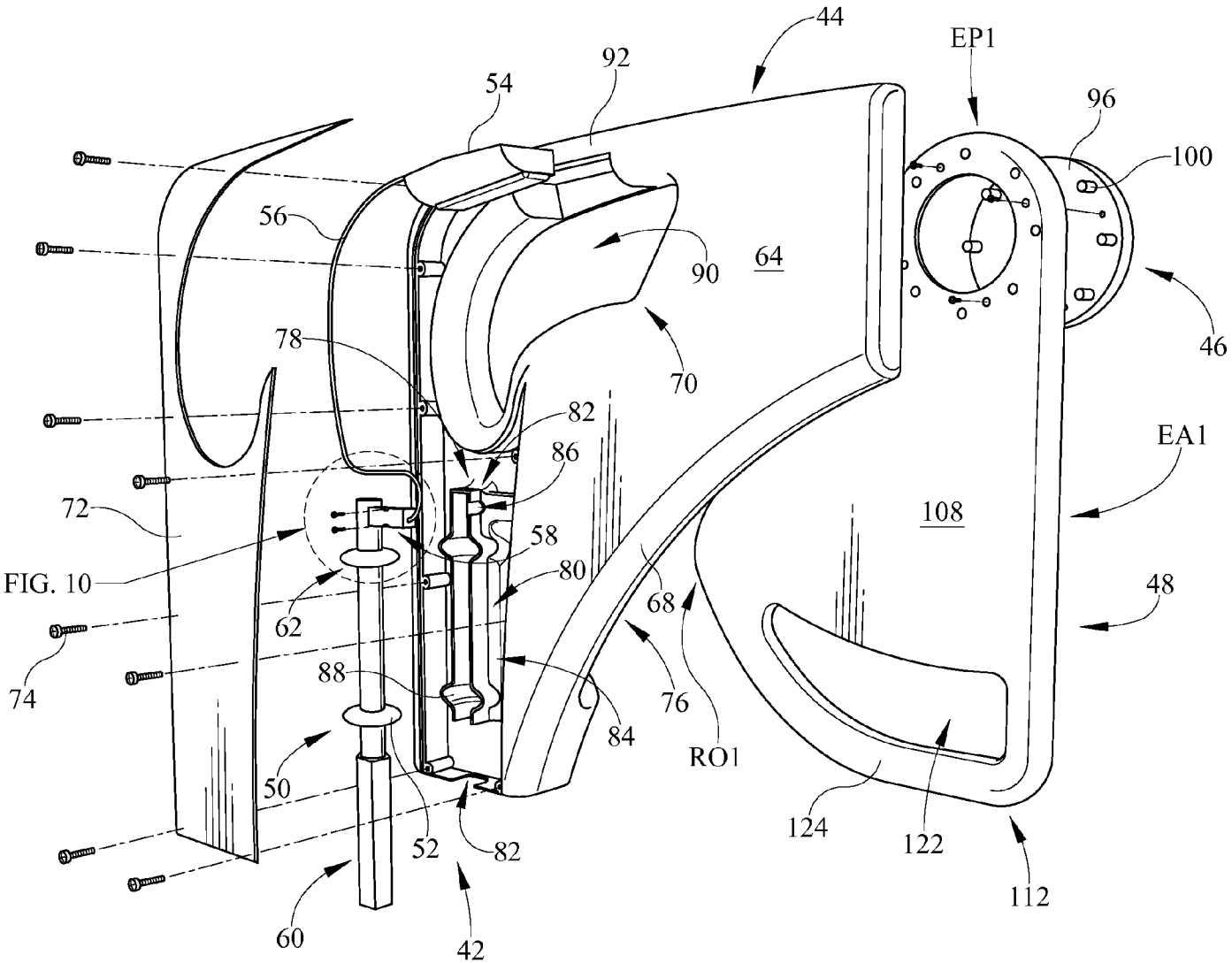
FIG. 9 is an exploded view of the footboard of FIG. 1 showing the first footboard body and the movement mechanism.
FIG. 10 is a perspective side view of the first movement mechanism of FIG. 4 showing the locking mechanism engaging the shaft.
Figure 10:
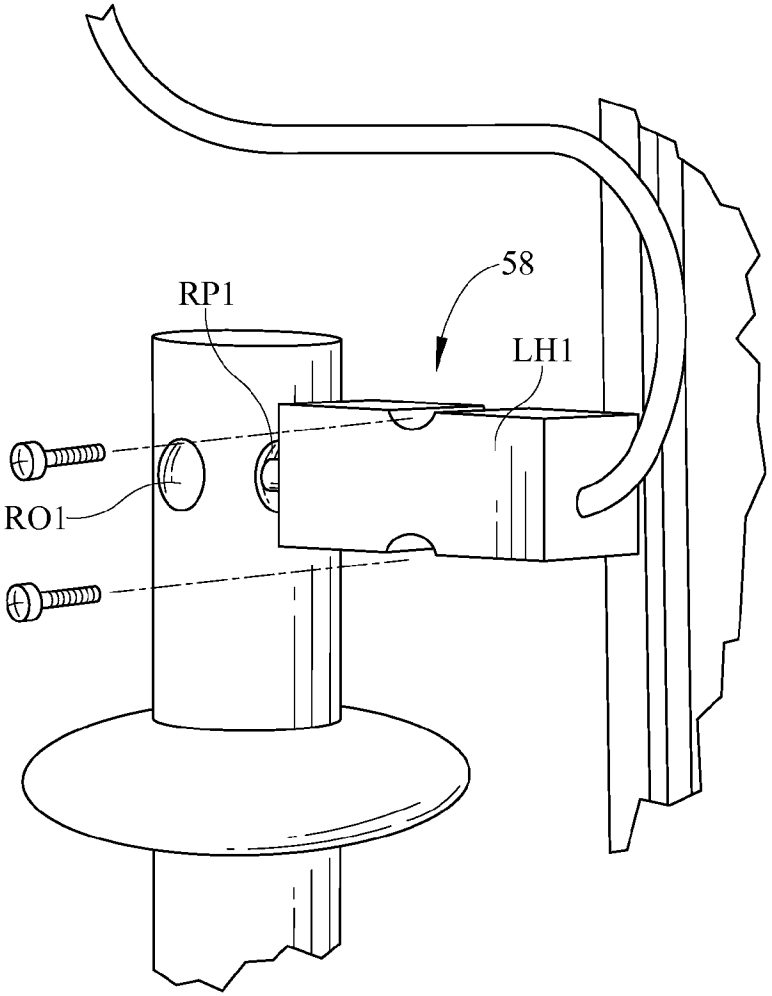

The footboard 28 can include a first body assembly 38 and a second body assembly 40 as shown in FIGS. 1-8. The first body assembly 38 and the second body assembly 40 can be similarly constructed and can include a first movement mechanism 42, a first footboard body 44, a second movement mechanism 46, and a second footboard body 48 as shown in FIGS. 7-13. It should be appreciated that like features are indicated in the Figures followed by an apostrophe. The first movement mechanism 42 can be configured to selectively allow the first footboard body 44 to move between a first rotational orientation and a second rotational orientation with respect to the upper frame 14. The first movement mechanism 42 can include a shaft 50 with retainer discs 52 coupled thereto, a handle 54, a cable 56, and a locking mechanism 58 as shown in FIGS. 9-10. The shaft 50 can include a first portion 60 protruding from the first footboard body 44 and a second portion 62 positioned within the first footboard body 44. The first portion 60 can have a substantially square cross-section that can be received in the square slot of the footboard receptacles 30 to prevent the shaft 50 from rotating with respect to the upper frame base 20. It should be appreciated that the shaft 50 can be prevented from rotating with respect to the upper frame base 20 in other ways, such as, for example, using a locking pin (not shown) to engage the upper frame base 20 and shaft 50, or having a spring loaded pin (not shown) coupled to the shaft 50 that can extend into an opening (not shown) in the upper frame base 20.

The second portion 62 can have a substantially circular cross-section and can facilitate movement of the first footboard body 44 with respect to the upper frame base 20. The second portion 62 can have the retainer discs 52 coupled thereto and can be selectively engaged by the locking mechanism 58 to prevent the first footboard body 44 from rotating with respect to the shaft 50 as shown in FIGS. 9-10. The retainer discs 52 can be configured to locate and/or retain the shaft 50 within the first footboard body 44. In one illustrative embodiment, the retainer discs 52 can be configured to space the first footboard body 44 a predetermined distance from the deck 22 and/or the upper frame base 20 to allow the first footboard body 44 to move with respect them without contacting them. It should be appreciated that the retainer discs 52 can be configured to space the first footboard body 44 a predetermined distance from the first portion 60 of the shaft 50 to allow the first footboard body 44 to move without contacting it. The locking mechanism 58 can be positioned within the first footboard body 44 and can be selectively actuated by the handle 54 via the cable 56. The locking mechanism 58 can include a lock housing LH1 with a pin RP1 that can be configured to selectively engage openings RO1 on the shaft 50 as shown in FIGS. 9-10. It should be appreciated that the pin RP1 can be spring loaded and can be selectively retracted by the cable as a function of the movement of the handle 54.

Figure 7:
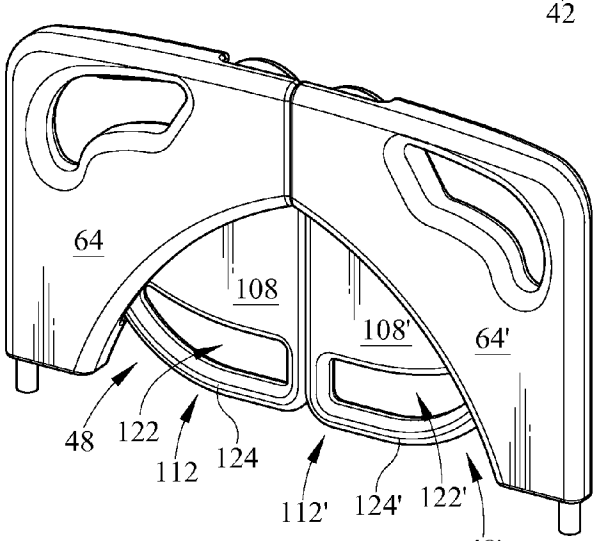
FIG. 7 is the perspective side view of the footboard of FIG. 1 showing the first footboard body and the first movement mechanism.

The first footboard body 44 can be movably coupled to the upper frame base 20 by the first movement assembly 30. The first footboard body 44 can be configured to selectively rotate between the first rotational orientation and the second rotational orientation with respect to the upper frame 14 about a first rotational axis R1 passing through the first movement assembly 30 as shown in FIGS. 7-8. In one illustrative embodiment, the first footboard body 44 can rotate about 270° between the first rotational orientation and the second rotational orientation. The first footboard body 44 can locate a first portion of the perimeter of the upper frame 14, i.e., the end of the foot support section S1, in the first rotational orientation and can locate a second portion of the perimeter of the upper frame 14, i.e., the side of the foot support section S1, in the second rotational orientation. It should be appreciated that the first footboard body 44 and the first footboard body 44' can be mirror images of one another about the longitudinal axis X1 in the first rotational orientation and can be substantially parallel to one another in the second rotational orientation. The first footboard body 44 can include a first surface 64, a second surface 66, a perimeter edge 68 extending between the first surface 64 and the second surface 66, and a first body grip portion 70. In one illustrative embodiment, a portion of the first surface 64 can be a cover 72 that can be removably coupled to the second surface 66 and/or perimeter edge 68 by a plurality of fasteners 74. The second surface 66 can include a recessed portion 76 that the second movement mechanism 46 can be coupled to and the can overlap as shown in FIG. 3. It should be appreciated that the recessed portion 76 is recessed at least the thickness of the second footboard body 48 so that the second surface 66 and a surface of the second footboard body 48 are substantially co-planar.

The first surface 64 can be spaced apart from the second surface 66 to define an inner chamber 78 with a first movement mechanism opening 80 into the inner chamber 78 and a first movement mechanism receptacle 82 positioned within the inner chamber 78 as shown in FIG. 9. The first movement mechanism opening 82 can pass through the perimeter edge 68 along the lower portion of the first footboard body 44 and can be configured to allow the shaft 50 to extend therethrough. The first movement mechanism receptacle 80 can be configured to receive and retain the second portion 62 of the shaft 50 within the first footboard body 44. The first movement mechanism receptacle 80 can be configured to mimic the shape of the second portion 62 of the shaft 50 and can include an upper portion 82 and a lower portion 84. The upper portion 82 can be slightly wider than the diameter of the first portion 60 of the shaft 50 and can include a locking opening 86 that can allow the locking mechanism 58 to pass through and engage the openings RO1 in the shaft 50. The lower portion 84 can include retainer disc receptacles 88 that can be configured to support and retain the retainer discs 52. The retainer disc receptacles 88 can be slightly wider than the diameter of the retainer discs 52 and slightly taller than the thickness of the retainer discs 52. It should be appreciated that the retainer disc receptacles 88 can be separated by a section slightly wider than the diameter of the first portion 60 of the shaft 50 and can have sections slightly wider than the diameter of the first portion 60 of the shaft 50 extending therefrom.

The first body grip portion 70 can be located along the upper portion of the first footboard body 44. The first body grip portion 70 can include a first body grip opening 90 passing through the first surface 64 and the second surface 66 that can cooperate with the perimeter edge 70 to define the first body grip 92 as shown in FIGS. 7-9 and 11. The first body grip 92 can have the handle 54 of the first movement mechanism 42 incorporated therein. The handle 54 can be configured to be moved between a first position and a second position with respect to the first body grip 92 to lock and release, respectively, the locking mechanism 58 so that the first footboard body 44 can be selectively rotated between the first rotational orientation and the second rotational orientation. It should be appreciated that the first body grip portion 70 can be gripped by a person to transport the person-support apparatus 10 and/or remove the first body assembly 38 and/or the second body assembly 40 from the upper frame base 20. It should be appreciated that the handle 54 can be a spring loaded handle.

Figure 11:
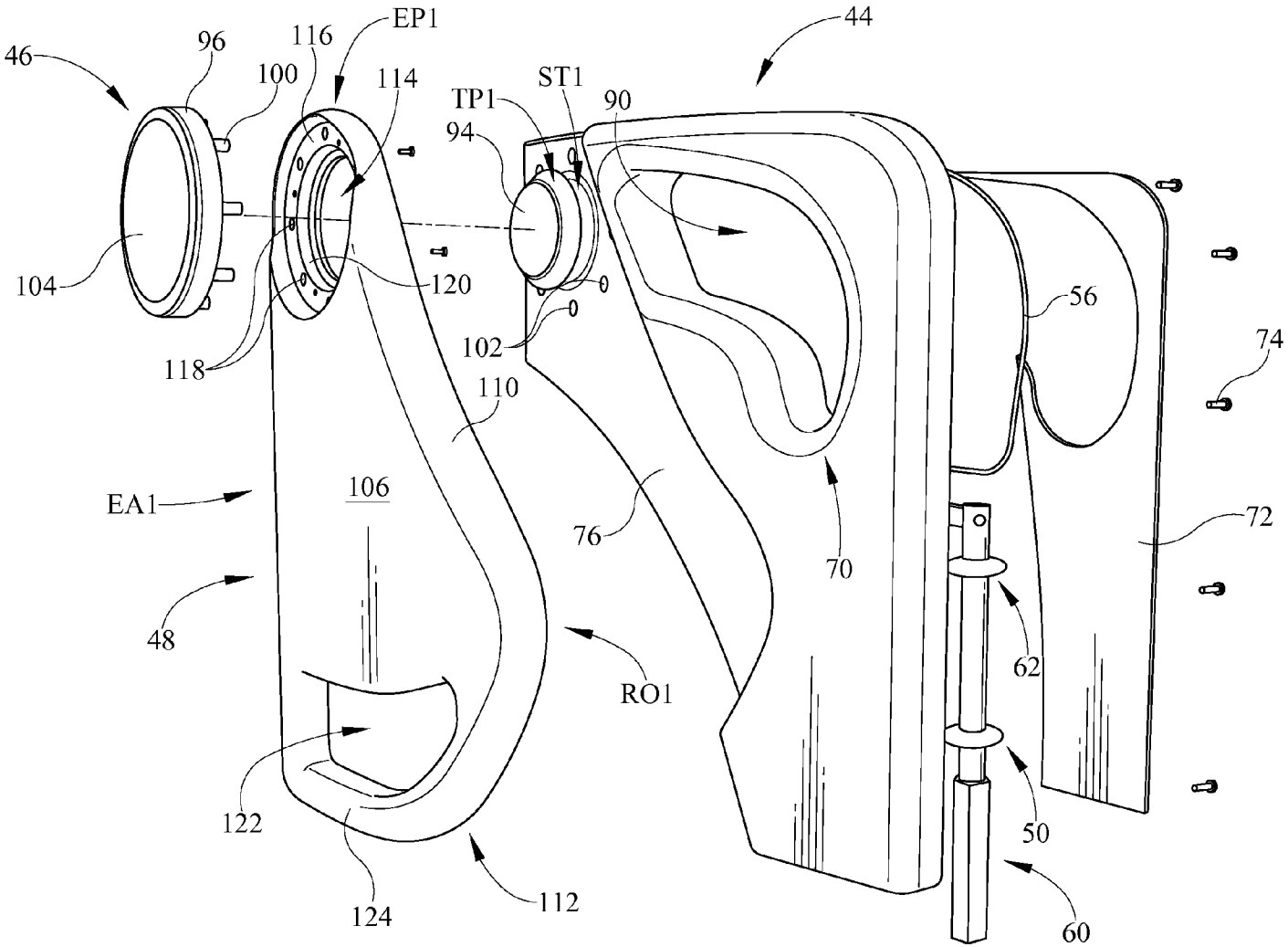
FIG. 11 is an exploded view of the footboard of FIG. 1 showing the first footboard body, the second movement mechanism, and the second footboard body.
Figure 13:
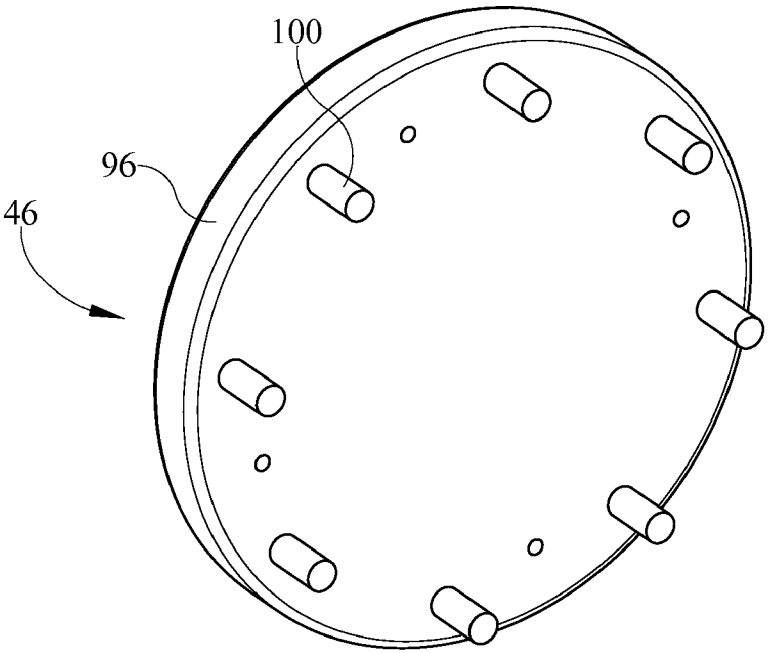
FIG. 13 is a perspective side view of the second movement mechanism of FIG. 6 with the locking pins extended.
Figure 12:
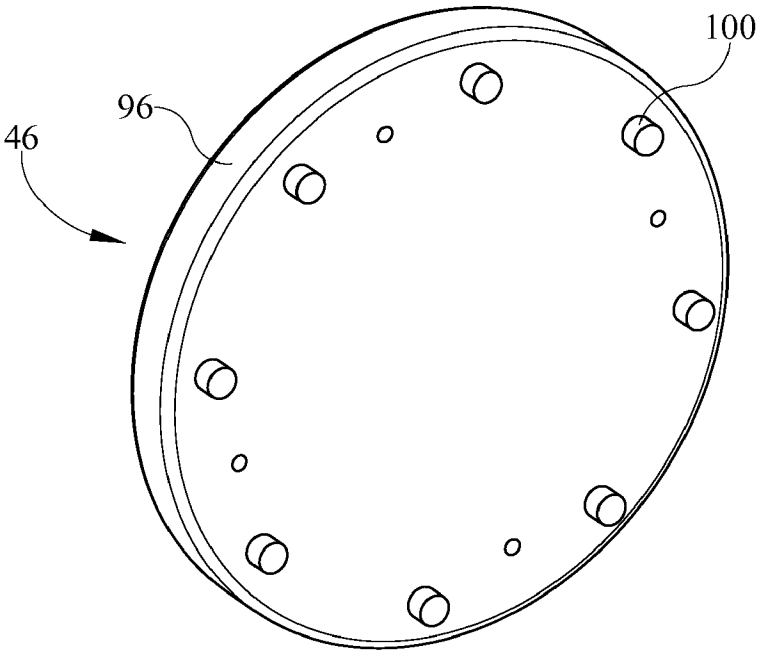
FIG. 12 is a perspective side view of the second movement mechanism of FIG. 6 with the locking pins retracted.

The second movement mechanism 46 can be configured to selectively allow the second footboard body 48 to move with respect to the first footboard body 44. The second movement mechanism 46 can include a base 94 and a positioning assembly 96 as shown in FIGS. 7-9 and 11-13. The base 94 can be coupled to the recessed portion 76 of the first footboard body 44 and can include a stem ST1 and a top TP1. The base 94 can be configured to provide a one-way snap fit to couple the second footboard body 48 to the first footboard body 44. It should be appreciated that the base 94 can be molded into the first footboard body 44 as shown in FIG. 11. The positioning assembly 96 can be coupled to the second footboard body 48 via fasteners 98 and can include a plurality of locking pins 100 configured to engage a plurality of locking holes 102 in the recessed portion 76. In one illustrative embodiment, the positioning assembly 96 can have a spring loaded button 104 that can be depressed to retract the locking pins 100 and allow the second footboard body 48 to move with respect to the first footboard body 44, and released to extend the locking pins 100 to engage the locking holes 102 to maintain the orientation of the second footboard body 48 with respect to the first footboard body 44. In one illustrative embodiment, the positioning assembly 96 can be a spring loaded button actuated release. In one illustrative embodiment, the positioning assembly 96 can be a Mechlok® type assembly. In another illustrative embodiment, the positioning assembly 96 can include a handle (not shown) that can be coupled to the second footboard body 48 and can be configured to move between a first position and a second position to actuate a spring loaded pin assembly (not shown) via a cable (not shown) to extend and retract at least one pin into/out of the locking holes 102.

The second footboard body 48 can be movably coupled to the first footboard body 44 by the second rotational mechanism 46. The second footboard body 48 can be configured to rotate between a storage position and a deployed position with respect to the first footboard body 44 about a second rotational axis R2 passing through the second rotational mechanism 46 as shown in FIGS. 7-8. In one illustrative embodiment, the second footboard body 48 can rotate about 270° between the storage position and the deployed position. The second footboard body 48 can have a second rotational mechanism engaging portion EP1, a recess overlapping portion R01, and an egress assist portion EA1 and can include a first surface 106, a second surface 108, a perimeter edge 110 extending between the first surface 106 and the second surface 108, and a second grip portion 112 as shown in FIGS. 7-9 and 11. The recess overlapping portion RO1 can be adjacent to the recessed portion 76 when the second footboard body 48 is in the storage position. The second grip portion 112 can be located along the egress assist portion EA1 and can include a second grip opening 122 passing through the first surface 106 and the second surface 108 and cooperating with the perimeter edge 110 to define a second grip 124. A portion of the perimeter edge 110 extending between the second grip portion 112 and the second movement mechanism 46 can be configured to cooperate with a portion of the perimeter edge 68 of the first footboard body 44 to define a substantially continuous upper perimeter edge when the second footboard body 48 is in the deployed position as shown in FIGS. 4 and 5. It should be appreciated that the portion of the perimeter edge 110 extending between the second grip portion 112 and the second movement mechanism 46 can be at an angle with respect to the portion of the substantially horizontal perimeter edge 68 of the first footboard body 44.

The second rotational mechanism engaging portion EP1 can include a first opening 114, a first positioning surface 116, and a plurality of locking pin openings 118 as shown in FIG. 11. The first positioning surface 116 can be recessed from the first surface 106 of the second footboard body 48 and can be configured to engage the second rotational mechanism 46. The first opening 114 can pass through the first positioning surface 116 and the second surface 108 and can be configured to allow the base 94 of the second movement mechanism 46 to pass therethrough. In one illustrative embodiment, the first opening 114 is countersunk from the first positioning surface 116 to form a retainer surface 120 configured to be engaged by the top TP1 of the base 94 to movably couple the second footboard body 48 to the first footboard body 44. The plurality of locking pin openings 118 can pass through the first positioning surface 116 and the second surface 108 and can be configured to allow the locking pins 100 to pass therethrough to engage the locking holes 102 in the first footboard body 44.

In operation, the first body assembly 38 and the second body assembly 40 can be initially positioned in the first rotational orientation such that they are mirror images of one another about the longitudinal axis X1. For the sake of brevity, the operation of only the first body assembly 38 will be described. To move the first body assembly 38 from the first rotational orientation to the second rotational orientation, the handle 54 coupled to the first body grip 92 is gripped and moves from the first position to the second position to disengage the pin RP1 from an opening OP1 on the shaft 50. The disengagement of the pin RP1 from the opening OP1 allows the first footboard body 44 to rotate about the first rotational axis R1. Once the first footboard body 44 reaches the second rotational orientation, i.e., substantially parallel to the longitudinal axis X1, the handle 54 is released and moves from the second position to the first position to allow the pin RP1 to engage an opening OP1 on the shaft 50 and prevent the first footboard body 44 from rotating with respect to the shaft 50.

Once the first footboard body 44 is maintained in the second rotational orientation, the second footboard body 48 can be rotated from the storage position to the deployed position. To rotate the second footboard body 48 from the storage position to the deployed position, the spring loaded button 104 is depressed to remove the locking pins 100 from the locking holes 102. Removing the locking pins 100 from the locking holes 102 allows the second footboard body 48 to rotate about the second rotational axis R2. After the second footboard body 48 reaches the deployed position, the button 104 is released to allow the locking pins 100 to be positioned in the locking holes 102 and prevent the second footboard body 48 from rotating with respect to the first footboard body 44. Once the first footboard body 44 is in the second rotational orientation and the second footboard body 46 is in the deployed position, a person can grip the second footboard body to ingress/egress to/from the person-support apparatus 10. In one illustrative embodiment, the person can ingress/egress to/from the side of the person-support apparatus when the person-support apparatus is in the substantially horizontal configuration as shown in FIGS. 1-4. In another illustrative embodiment, the person can ingress/egress to/from the person-support apparatus in the chair configuration as shown in FIGS. 5-6.

Many other embodiments of the present disclosure are also envisioned. For example, a person-support apparatus comprises a frame and an endboard. The frame is configured to support a person thereon. The frame includes an upper body support section and a lower body support section configured to move between a first angular orientation and a second angular orientation with respect to one another. The person is supported in a substantially horizontal position when the lower body support section and the upper body support section are in the first angular orientation and in a chair position when the lower body support section and the upper body support section are in the second angular orientation with respect to one another. The endboard is rotatably coupled to the lower body support section and configured to move with the lower body support section as the lower body support section moves between the first angular orientation and the second angular orientation. At least a portion of the endboard is configured to rotate with respect to the lower body support section between a first position configured to locate a portion of a perimeter of the lower body support section and a second position configured to assist a person attempting to at least one of ingress and egress to/from the frame.

In another example, an endboard for a person-support apparatus comprises an endboard assembly including a first endboard body rotatably coupled to a frame and a second endboard body rotatably coupled to the first endboard body. The second endboard body is configured to be movable between a storage position and a deployed position with respect to the first endboard body. The second endboard body is configured to assist a person during at least one of ingress and egress to/from the frame when the second endboard body is in the deployed position.

In another example, a person-support apparatus comprises a base frame, an upper frame, and a footboard. The upper frame is supported above the base frame and configured to support a person thereon. The upper frame includes an upper body support section and a lower body support section. The upper body support section and the lower body support section are configured to cooperate to move between a substantially horizontal configuration and a chair configuration. The footboard is movably coupled to the lower body support section and is configured to move therewith. The footboard is rotated with respect to the lower body support section between a first position and a second position. The footboard is configured to be gripped by a person to assist the person during at least one of ingress and egress to/from the person-support apparatus when the upper frame is in the chair configuration.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless can not be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles can have been presented, they need not be utilized in combination, and various combinations of inventive aspects and principles are possible in light of the various embodiments provided above.

What is claimed is:

1. An endboard for a person-support apparatus, comprising:

an endboard assembly including a first endboard body configured to be rotatably coupled to a frame and a second endboard body rotatably coupled to the first endboard body, the second endboard body being configured to be movable between a storage position and a deployed position with respect to the first endboard body, wherein the second endboard body is configured to assist a person during at least one of ingress and egress to/from the frame when the second endboard body is in the deployed position, wherein the first endboard body is configured to rotate about a first rotational axis with respect to the frame and the second endboard body is configured to rotate about a second rotational axis with respect to the first endboard body, wherein the second rotational axis is perpendicular to the first rotational axis.

2. The person-support apparatus of claim 1, wherein the first endboard body is coupled to the frame by a first movement mechanism configured to selectively maintain the orientation of the first endboard body with respect to the frame.

3. The person-support apparatus of claim 1, wherein the first endboard body includes a recessed portion, the second endboard body being adjacent to the recessed portion in the storage position.

4. The person-support apparatus of claim 3, wherein the recessed portion is recessed from a first surface of the first endboard body, the first surface being substantially flush with a surface of the second endboard body when the second endboard body is in the storage position.

5. The person-support apparatus of claim 4 further comprising a second endboard assembly including a third endboard body rotatably coupled to a frame and a fourth endboard body rotatably coupled to the third endboard body, the first endboard body and the third endboard body being substantially co-planar in a first rotational orientation with respect to the frame and substantially parallel to one another in a second rotational orientation with respect to the frame.

6. The person-support apparatus of claim 5, wherein the first endboard body and the third endboard body locate an end of the frame in the first rotational orientation and locate sides of the frame in the second rotational orientation.

7. The person-support apparatus of claim 1, wherein the second endboard body is configured to be selectively maintained in at least one of the storage position and the deployed position by a locking mechanism.

8. An endboard for a person-support apparatus, comprising:

an endboard assembly including a first endboard body rotatably coupled to a frame and a second endboard body rotatably coupled to the first endboard body, the second endboard body being configured to be rotated between a storage position and a deployed position with respect to the first endboard body, wherein the second endboard body is configured to assist a person during at least one of ingress and egress to/from the frame when the second endboard body is in the deployed position.

9. The person-support apparatus of claim 8 further comprising a second endboard assembly including a third endboard body rotatably coupled to a frame and a fourth endboard body rotatably coupled to the third endboard body, the first endboard body and the third endboard body being substantially co-planar in a first rotational orientation with respect to the frame and substantially parallel to one another in a second rotational orientation with respect to the frame.

10. The person-support apparatus of claim 9, wherein the first endboard body and the third endboard body locate an end of the frame in the first rotational orientation and locate sides of the frame in the second rotational orientation.

11. The person-support apparatus of claim 8, wherein the first endboard body is configured to rotate about a first rotational axis with respect to the frame and the second endboard body is configured to rotate about a second rotational axis with respect to the first endboard body, wherein the second rotational axis is perpendicular to the first rotational axis.

12. The person-support apparatus of claim 8, wherein the first endboard body is coupled to the frame by a first movement mechanism configured to selectively maintain the orientation of the first endboard body with respect to the frame.

13. The person-support apparatus of claim 8, wherein the first endboard body includes a recessed portion, the second endboard body being adjacent to the recessed portion in the storage position.

14. The person-support apparatus of claim 13, wherein the recessed portion is recessed from a first surface of the first endboard body, the first surface being substantially flush with a surface of the second endboard body when the second endboard body is in the storage position.

15. The person-support apparatus of claim 8, wherein the second endboard body is configured to be selectively maintained in at least one of the storage position and the deployed position by a locking mechanism.

16. An endboard for a person-support apparatus, comprising:

an endboard assembly including a first endboard body configured to be rotatably coupled to a frame and a second endboard body rotatably coupled to the first endboard body, the second endboard body being configured to be rotatable between a storage position and a deployed position with respect to the first endboard body, wherein the second endboard body is configured to assist a person during at least one of ingress and egress to/from the frame when the second endboard body is in the deployed position, wherein the second endboard body is configured to be selectively maintained in at least one of the storage position and the deployed position by a locking mechanism.

17. The person-support apparatus of claim 16, wherein the first endboard body is configured to rotate about a first rotational axis with respect to the frame and the second endboard body is configured to rotate about a second rotational axis with respect to the first endboard body, wherein the second rotational axis is perpendicular to the first rotational axis.

18. The person-support apparatus of claim 16, wherein the first endboard body is coupled to the frame by a first movement mechanism configured to selectively maintain the orientation of the first endboard body with respect to the frame.

19. The person-support apparatus of claim 16, wherein the first endboard body includes a recessed portion, the second endboard body being adjacent to the recessed portion in the storage position.

20. The person-support apparatus of claim 19, wherein the recessed portion is recessed from a first surface of the first endboard body, the first surface being substantially flush with a surface of the second endboard body when the second endboard body is in the storage position.

21. The person-support apparatus of claim 16 further comprising a second endboard assembly including a third endboard body rotatably coupled to a frame and a fourth endboard body rotatably coupled to the third endboard body, the first endboard body and the third endboard body being substantially co-planar in a first rotational orientation with respect to the frame and substantially parallel to one another in a second rotational orientation with respect to the frame.

* * * * *